US005819945A

United States Patent [19]

Laskowski et al.

[11] Patent Number: 5,819,945

[45] Date of Patent: Oct. 13, 1998

[54] BIMODAL DENSE MEDIUM FOR FINE PARTICLES SEPARATION IN A DENSE MEDIUM CYCLONE

[75] Inventors: Janusz S. Laskowski, Richmond; Ying Bin He, Vancouver, both of Canada

[73] Assignee: University of British Columbia, Vancouver, B. C., Canada

[21] Appl. No.: 521,371

[22] Filed: Aug. 31, 1995

[51] Int. Cl.[6] ..... B03B 9/00

[52] U.S. Cl. ..... 209/2; 209/725

[58] Field of Search ..... 209/725, 727, 209/730, 2, 132, 208

[56] References Cited

U.S. PATENT DOCUMENTS

| | | | |
|---|---|---|---|
| 4,128,474 | 12/1978 | Ennis | 209/727 X |
| 4,140,628 | 2/1979 | Horsfall | 209/727 X |
| 4,470,901 | 9/1984 | Burgess | 209/172.5 X |
| 5,022,892 | 6/1991 | Klima et al. . | |
| 5,096,066 | 3/1992 | Kindig | 209/727 X |
| 5,262,962 | 11/1993 | Kindig . | |
| 5,277,368 | 1/1994 | Kindig . | |
| 5,348,160 | 9/1994 | Kindig . | |

OTHER PUBLICATIONS

Y.B. He et al., "Effect of Dense Medium Properties on the Separation Performance of a Dense Medium Cyclone", Minerals Engineering, vol. 7, 209–221 (1994).

R.D. Stoessner, et al., "Selection of Dense Medium Cyclones for Low Gravity Fine Coal Cleaning", Proc. 3rd Int. Conf. on Hydrocyclones, Oxford, 1987.

B. Collins, et al., "The production, properties and selection of ferrosilicon powders for heavy–medium separation", J.S. Afr. IMM, vol. 12, 103–119 (1974).

D.N. Collins, et al., "Separation efficiency in dense media cyclones", Trans. Instn. Min. Metall., (Sect. C: Mineral Process. Extr. Metall.), 92, (1983).

P.J.F. Fourie, et al., "The beneficiation of fine coal by dense–medium cyclone", J.S. Afr. IMM, vol. 80, 357–361 (1980).

David G. Chedgy, et al., "Heavy media cyclone separations at ultralow specific gravity", Proc. 10th Int. Coal Preparation Congress, Edmonton, 1986, pp. 60–79.

M.S. Klima, et al., "Development of a Microionized–Magnetite Cycloning Process", Proc. 11th Int. Coal Preparation Congress, Tokyo, 1990, pp. 145–149.

M.S. Klima, et al., "An Update on the Development of DOE's Micro–Mag Process", Soc. for Mining, Metallurgy, and Exploration, 1992.

*Primary Examiner*—David H. Bollinger

*Attorney, Agent, or Firm*—Oyen Wiggs Green & Mutala

[57] ABSTRACT

The present invention provides a method for separation of fine particles in a bimodal (two component) dense medium. In accordance with the present invention, the dense medium comprises ferromagnetic particles that have a relative density range from about 4.0 to 7.0 suspended in water and are characterized by a bimodal size distribution. Such a medium exhibits high stability and favourable rheological properties. The use of such a bimodal magnetite dense medium in cleaning fine coal in a dense medium cyclone or dynamic dense medium separator results in optimum separation efficiency when the medium contains approximately 20–40% fine and 60–80% coarse magnetite, and when the size ratio of coarse-to-fine magnetite is in the range of 5 to 10.

15 Claims, 4 Drawing Sheets

BIMODAL DENSE MEDIUM FOR FINE PARTICLES SEPARATION IN A DENSE MEDIUM CYCLONE

FIELD OF THE INVENTION

This invention relates to a novel method of separating fine particles in a dense medium. More particularly, this invention pertains to a unique method of separating fine particles in a dense medium comprising water and ferromagnetic particles characterized by a bimodal particle size distribution.

BACKGROUND OF THE INVENTION

Dense medium dynamic separators such as dense medium cyclones have been used for many years to separate dense medium mixtures into components. Such separators include dense medium cyclones, swirl cyclones, NCB vorsyl separators, Dyna Whirlpool separators, Tri-flo separators, and the like.

Factors that affect dense medium cyclone performance can be categorized into three groups: medium properties (composition), cyclone operating conditions, and feed characteristics. While the cyclone operating conditions are designed based on the feed characteristics, the selection of medium composition must be made by taking into consideration both feed characteristics and cyclone operating conditions. Based on this principle, the separation of fine particles requires the use of high centrifugal acceleration which is achieved by elevated cyclone inlet pressure or reduced cyclone diameter. Both fine feed particle size and high centrifugal acceleration necessitate the use of fine dense medium suspensions. This has prompted the development of the micro-mag, an ultrafine magnetite which is produced by grinding (see U.S. Pat. No. 5,022,892, 1991).

U.S. Pat. No. 5,022,892, granted Jun. 11, 1991, Klima et al., discloses a method of cleaning particulate coal which is fed with a dense medium slurry as an inlet feed to a cyclone separator. The coal particle size distribution is in the range of from about 37 microns to about 600 microns. The dense medium comprises water and ferromagnetic particles that have a relative density in the range of from about 4.0 to about 7.0. The ferromagnetic particles of the dense medium have particle sizes of less than about 15 microns and at least a majority of the particle sizes are less than about 5 microns. In the cyclone, the particulate coal and dense-medium slurry is separated into a low gravity product stream and a high gravity product stream wherein the differential in relative density between the two streams is not greater than about 0.2. The low gravity and high gravity streams are treated to recover the ferromagnetic particles therefrom.

Although technically feasible, the use of ultrafine magnetite dense medium also causes serious problems. Major drawbacks include unfavourable rheological properties of such a medium (Y. B. He and J. S. Laskowski, 12th Int. Coal Preparation Congress, Krakow 1994, paper C-8) and its high production cost. The highly viscous dense medium reduces separation efficiency of fine particles, especially at high medium densities.

The performance of dense medium cyclones (DMC) is strongly affected by medium properties, especially in the separation of fine particles (<0.5 mm) (Y. B. He and J. S. Laskowski, Minerals Engineering, Vol. 7, 209–221 (1994)). While rheology and stability are the fundamental medium properties that are most directly related to DMC performance, these properties are controlled and modified by medium composition. The composition variables include medium solids content (or medium density), magnetite particle size distribution, particle shape, level of contamination, and degree of demagnetization. With conventional dense medium, any attempt to improve the medium stability will adversely affect the medium rheological properties, or vice versa. The dilemma is further exacerbated with dense medium separation of fine particles where high centrifugal acceleration becomes an essential operating requirement.

Stoessner and Zawadzki (Proc. 3rd Int. Conf. on Hydrocyclones, Oxford, 1987), in studying the effect of magnetite particle size, reported that the DMC performs better with coarse than with fine magnetite. They attributed this to the deleterious effect of viscosity on DMC performance with fine magnetite. A similar observation was reported by Collins et al. (J. S. Afr. IMM, Vol. 12, 103–119 (1974)) when working at high medium densities on iron ore separation. They advocated the use of spherical medium particles to reduce the effect of viscosity and showed that the use of atomized (spherical) ferrosilicon resulted in a better separation efficiency than the use of ground, irregular shaped particles. On the other hand, increasing magnetite particle size may deteriorate medium stability. As a result, Sokaski and Geer (U.S. Bureau of Mines, RI 6274 (2963)), in evaluating the performance of a 250 mm DMC in separating coal, found that finer magnetite provided sharper separation. Similar findings were also reported by Fourie et al. (J. S. Afr. IMM, Vol. 80, 357–361 (1980)) and Chedgy et al. (Proc. 10th Int. Coal Preparation Congress, Edmonton, 1986, pp. 60–79). They all claimed that with progressively finer magnetite, a better separation efficiency was obtained due to improved medium stability. Fourier et al. recommended that for sharp separation of coal, at least 50 percent of the magnetite be finer than 10 microns.

When using a commercial grade magnetite at low medium densities, Chedgy et al., above, found that separation efficiency deteriorated when the cyclone inlet pressure was raised, and that performance of small diameter cyclones at high feed pressures was inferior to that of large diameter cyclones tested under similar conditions. Klima and Killmeyer (Proc. 11th Int. Coal Preparation Congress, Tokyo, 1990, pp. 145–149) observed that when the cyclone inlet pressure was increased from 35 to 372 kPa, the separation efficiency was substantially improved in the separation of fine coal using micronized magnetite (90%<5$^{a}$m). These different results suggest that with coarse commercial magnetite in the first case, the adverse effect of increased medium segregation more than offsets the beneficial gain of higher centrifugal acceleration achieved at elevated inlet pressures (or smaller cyclone diameters). The very stable micronized-magnetite medium in the second case, however, allows a high centrifugal acceleration to be used without inducing an unduly high medium segregation.

The following patents of Kindig relate generally to the beneficiation of fine particle coal, magnetite and dense medium cyclones.

U.S. Pat. No. 5,348,160, Kindig, granted Sep. 20, 1994, discloses beneficiation of fine particle coal in specially designed dense medium cyclones to improve particle acceleration and enhance separation efficiency. Raw coal feed is first sized to remove fine coal particles. The coarse fraction is then separated into clean coal, middlings, and refuse. Middlings are comminuted for beneficiation with the fine fraction. The fine fraction is deslimed in a countercurrent cyclone circuit and then separated as multiple fractions of different size specifications in dense medium cyclones. The dense medium contains ultra-fine magnetite particles of a narrow size distribution which aid separation and improves magnetite recovery. Magnetite is recovered from each separated fraction independently, with non-magnetic effluent water from one fraction diluting feed to a smaller-size fraction, and improving both overall coal and magnetite recovery. Magnetite recovery is in specially designed recovery units, based on particle size, with final separation in a rougher-cleaner-scavenger circuit of magnetic drum separators incorporating a high strength rare earth magnet.

U.S. Pat. No. 5,277,368, Kindig, granted Jan. 11, 1994, discloses beneficiation of fine particle coal in specially designed dense medium cyclones to improve particle acceleration and enhance separation efficiency. Raw coal feed is first sized to remove fine coal particles. The coarse fraction is then separated into clean coal, middlings, and refuse. Middlings are comminuted for beneficiation with the fine fraction. The fine fraction is deslimed in a countercurrent cyclone circuit and then separated as multiple fractions of different size specifications in dense medium cyclones. The dense medium contains ultra-fine magnetite particles of a narrow size distribution which aid separation and improves magnetite recovery. Magnetite is recovered from each separated fraction independently, with non-magnetic effluent water from one fraction diluting feed to a smaller-size fraction, and improving both overall coal and magnetite recovery. Magnetite recovery is in specially designed recovery units, based on particle size, with final separation in a rougher-cleaner-scavenger circuit of magnetic drum separators incorporating a high strength rare earth magnet.

U.S. Pat. No. 5,262,962, Kindig, granted Nov. 16, 1993, discloses a method for selecting magnetite to form a dense media for beneficiation of fine particulate solids such that the particulate solids are as buoyant with respect to the dense media as if the solids were in a true liquid having a specific gravity equal to that of the dense media. The method involves determining a magnetite particle diameter such that the diameter ratio of particulate solid to magnetite lies above a diameter ratio partition curve. The invention is also directed toward using magnetite having a particle diameter less than about 0.005 mm and a mean particle diameter of about 0.0025 mm. Such magnetite is formed from a gas phase pyrohydrolysis reaction on an aqueous iron (ferrous) chloride solution. The present invention is further directed towards a method for determining the efficiency of separation of a dense media separation process. This method includes determining an apparent distance a particle must travel in a dense media cyclone to be correctly beneficiated. From this apparent distance, an apparent velocity a particle must achieve to be correctly beneficiated is calculated. This apparent velocity is used, along with cyclone geometry and operational parameters to calculate a divergence value which indicates the efficiency of separation. The patent also discloses a method for selecting cyclone geometry and operating parameters which includes determining separation efficiency and adjusting geometry and parameters in a manner to obtain improved efficiency.

U.S. Pat. No. 5,096,066, Kindig, granted Mar. 17, 1992, discloses a method for selecting magnetite to form a dense media for beneficiation of fine particulate solids such that the particulate solids are as buoyant with respect to the dense media as if the solids were in a true liquid having a specific gravity equal to that of the dense media. The method involves determining a magnetite particle diameter such that the diameter ratio of particulate solid to magnetite lies above a diameter ratio partition curve. The invention is also directed toward using magnetite having a particle diameter less than about 0.005 mm and a mean particle diameter of about 0.0025 mm. Such magnetite is formed from a gas phase pyrohydrolysis reaction on an aqueous iron (ferrous) chloride solution. The invention is further directed towards a method for determining the efficiency of separation of a dense media separation process. This method includes determining an apparent distance a particle must travel in a dense media cyclone to be correctly beneficiated. From this apparent distance, an apparent velocity a particle must achieve to be correctly beneficiated is calculated. This apparent velocity is used, along with cyclone geometry and operational parameters to calculate a divergence value which indicates the efficiency of separation. The invention also includes a method for selecting cyclone geometry and operating parameters which includes determining separation efficiency and adjusting geometry and parameters in a manner to obtain improved efficiency.

SUMMARY OF THE INVENTION

The overall invention herein involves a novel formula for ferromagnetic particle size distribution so that it presents optimum medium properties. The invention provides a method for separation of fine particles in a bimodal (two component) dense medium. In accordance with the present invention, the dense medium comprises ferromagnetic particles that have a relative density range from about 4.0 to 7.0 suspended in water and are characterized by a bimodal size distribution. Such a medium exhibits high stability and favourable rheological properties. The invention has applicability to dense medium separators in general. In particular, the use of such a bimodal magnetite dense medium in cleaning fine coal in a dense medium cyclone results in optimum separation efficiency.

In a specific embodiment, the invention includes a method of separating fine particles differing in density into density fractions comprising feeding to a dense medium separator a dense medium that includes water and ferromagnetic particles having a relative density range from about 4.0 to 7.0, a bimodal size distribution characterized by about 20–40% wt. fine and 60–80% wt. coarse fractions, with coarse-to-fine particle size ratio in the range from about 5 to about 10.

In the method, the separator can be a dense medium cyclone and the feed to the dense medium cyclone can include fine coal particles of less than 600 microns size, and the bimodal dense medium has a medium relative density from about 1.2 to about 1.9. The ferromagnetic particles in the dense medium can be $Fe_3O_4$ or FeSi.

The invention also includes a method of cleaning coal comprising feeding to a dense medium cyclone a mixture of: (a) fine coal particles; (b) water; and (c) ferromagnetic particles having a relative density range from about 4.0 to about 7.0, a bimodal size distribution characterized by about 20–40% wt. fine fractions and about 60–80% wt. coarse fractions, with a coarse-to-fine particle size ratio in the range of about 5 to about 10.

In the method, the mixture can be fed to the dense medium cyclone at an inlet pressure from about 40 kPa to about 400 kPa. The fine coal particles can be less than 600 microns in size, and the bimodal magnetite dense medium can have a medium relative density from about 1.2 to about 1.9.

The fine ferromagnetic particles can have a size in the range of about 1 to about 10 microns and the coarse ferromagnetic particles can have a size in the range of about 10 to about 45 microns.

The objective of the present invention is to provide a method of formulating the particle size distribution of the dense medium. Such an optimum distribution improves stability and reduces viscosity of the dense medium.

The invention is also directed to a dense medium for use in a dynamic dense medium separator to separate particles differing in density into density fractions, said dense medium comprising: (a) water; and (b) ferromagnetic particles having a relative density range from about 4.0 to 7.0, a bimodal size distribution charactrized by about 20–40% wt. fine and 60–80% wt. coarse fractions, with coarse-to-fine particle size ratio in the range from about 5 to about 10.

The present invention also provides a method for preconcentrating various fine mineral particles such as diamond in which the medium relative density is in the range of 1.7 to 3.2. Over such a high density range, the advantage of using bimodal ferromagnetic dense medium will be more substantially manifested.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE PREFERRED EMBODIMENT

Figure 1:
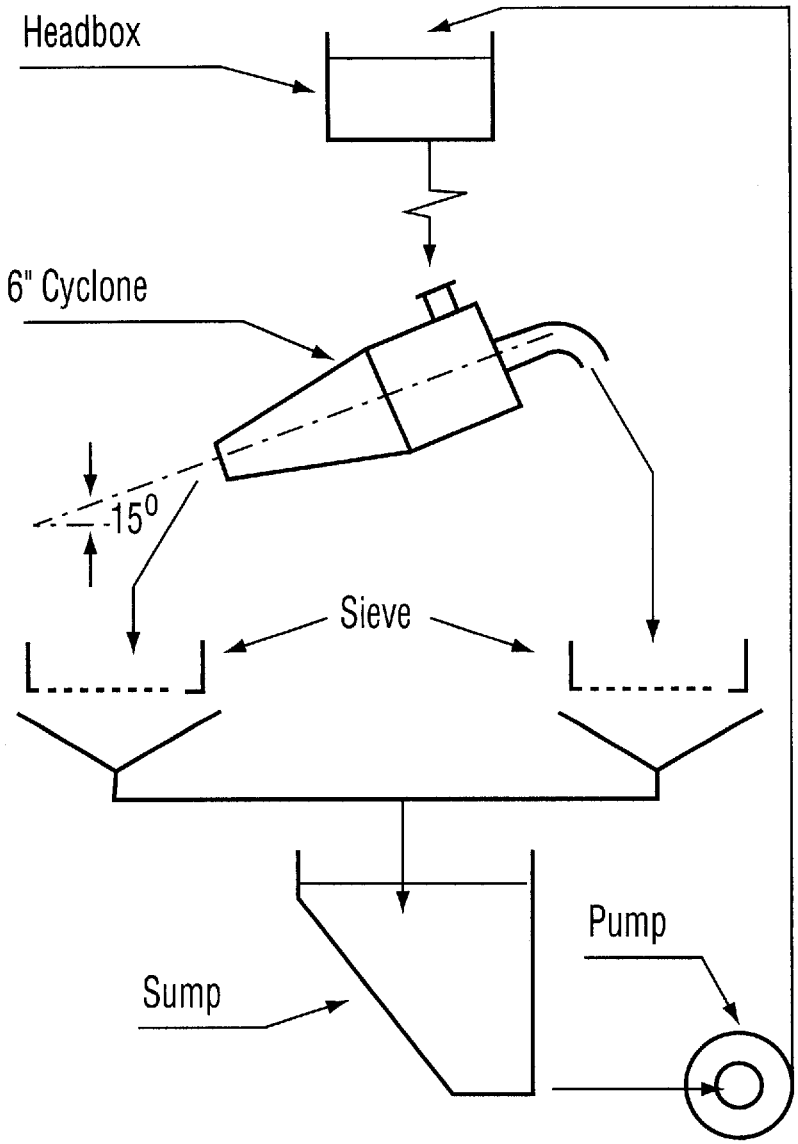
FIG. 1 illustrates a schematic diagram of the 6 inch dense medium cyclone loop.

We have discovered that an optimum medium composition for DMC separation can be achieved with bimodal magnetite suspensions. This composition provides both high medium stability and low medium yield stress. In DMC separation of fine particles using a bimodal magnetite dense medium, we have discovered that the separation efficiency is closely related to the medium rheology. The minimum Ep value is obtained when the fine magnetite accounts for around 25% of the total magnetite content. This composition corresponds to the optimum rheological composition for bimodal suspensions. On the other hand, the cutpoint shift is more closely related to the medium stability; increasing the proportion of the fine magnetite in the medium reduces the density differential resulting in a continuous decrease in the cutpoint shift.

In the first set of tests, conventional magnetite samples (Mag#1, 2, 3 and 4) were used to prepare the dense media over the medium density range from 1.2 to 1.7 g/cm$^3$ (% solids). Their particle size could be adequately described by the Rosin-Rammler-Bennet particle size distribution. Mag#1 was a commercial grade magnetite provided by Craigmont Mines. Mag#2 was obtained by grinding Mag#1 in a ball mill. Mag#3 and Mag#6 were obtained by classifying Mag#1 in a classifying cyclone to eliminate fines. Mag#4 and Mag#5 were the micronized-magnetites (70%<5$^a$m and 90%<5$^a$m, respectively) provided by the U.S. Department of Energy, Pittsburgh Energy Technology Centre. The colour-coded density tracers, obtained from Partition Enterprises Ltd., Australia, were used as cyclone feed. Three narrow size fractions were used in the tests: 4.0×2.0, 1.0×0.71, and 0.5×0.355 mm. Table 1 tabulates RRB size and distribution moduli of the six magnetite samples. As Table 1 shows, these magnetite samples cover a wide particle size range from micronized magnetite with $d_{63.2}$=2.7 $\mu$m to a very coarse magnetite with a $d_{63.2}$=35.0 $\mu$m.

TABLE 1

RRB Size and Distribution Moduli of the Magnetite Samples

| Sample | $d_{63.2}$ ($\mu$m) | m |
|---|---|---|
| Mag#1 | 30.5 | 3.5 |
| Mag#2 | 18.0 | 1.6 |
| Mag#3 | 33.0 | 4.1 |
| Mag#4 | 4.3 | 1.9 |
| Mag#5 | 2.7 | 2.5 |
| Mag#6 | 35.0 | 3.9 |

During the separation tests, density tracers of different densities were always kept separate. In each run, only one density fraction was introduced into the cyclone loop from the headbox. The minimum weight for each density fraction was about 100 grams, the tracer particles reporting to overflow and underflow were recovered on two screens mounted in the sampling boxes, while the carrying medium passing through the screen was recycled. The tracer particles retained by the two screens were washed, dried and weighed separately. This was used to calculate the partition number. The whole process was repeated with different density fractions to get enough data points for construction a partition curve. To ensure accuracy, duplicate data points, especially around the separation cut point, were produced. The densities and flow rates of the overflow and underflow media were monitored throughout the testing. From these data, the overflow-to-underflow flow rate ratios and density differentials were calculated.

The separation tests were conducted in a 6" dense medium cyclone loop. The 6" cyclone (model D6B-12-S287) was obtained from Krebs Engineers International, California. It was gravity fed at an inlet pressure of 60.6" liquid column (10 times the cyclone diameter). In this regard, reference should be made to Y. B. He and J. S. Laskowski, Mineral Engineering, Vol. 7, 209–221 (1994), the subject matter of which is incorporated herein by reference. The circuit configuration was first optimized based on the conditions given by He and Laskowski. A medium split ratio of 1.8, which is within the recommended range (2±0.5), was obtained using a 2.5" vortex finder and a 2.0" spigot. FIG. 1 illustrates a schematic diagram of the 6", dense medium cyclone loop.

Figure 2:
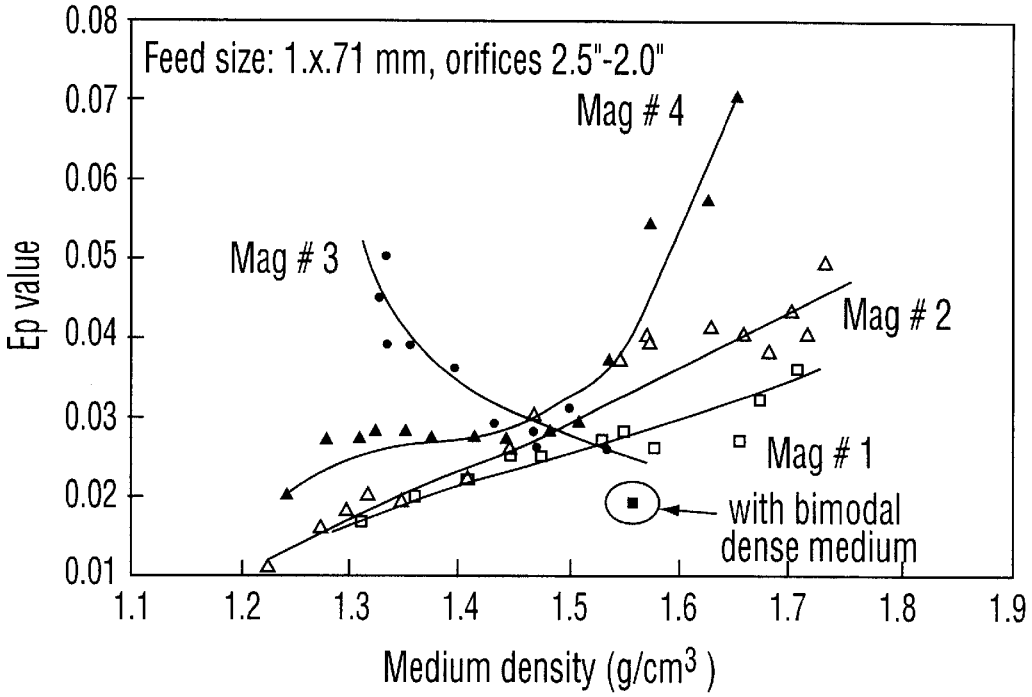
FIG. 2 is a graph which illustrates the effect of medium composition on DMC separation efficiency.

Separation efficiency as a function of medium density and particles size is shown in FIG. 2. Two conflicting trends in the relationship between Ep value and medium density can be observed. With Mag#1, Mag#2 and Mag#4 dense media, the Ep values tend to increase with medium density, while it decreases for the coarse Mag#3 dense medium.

Figure 3:
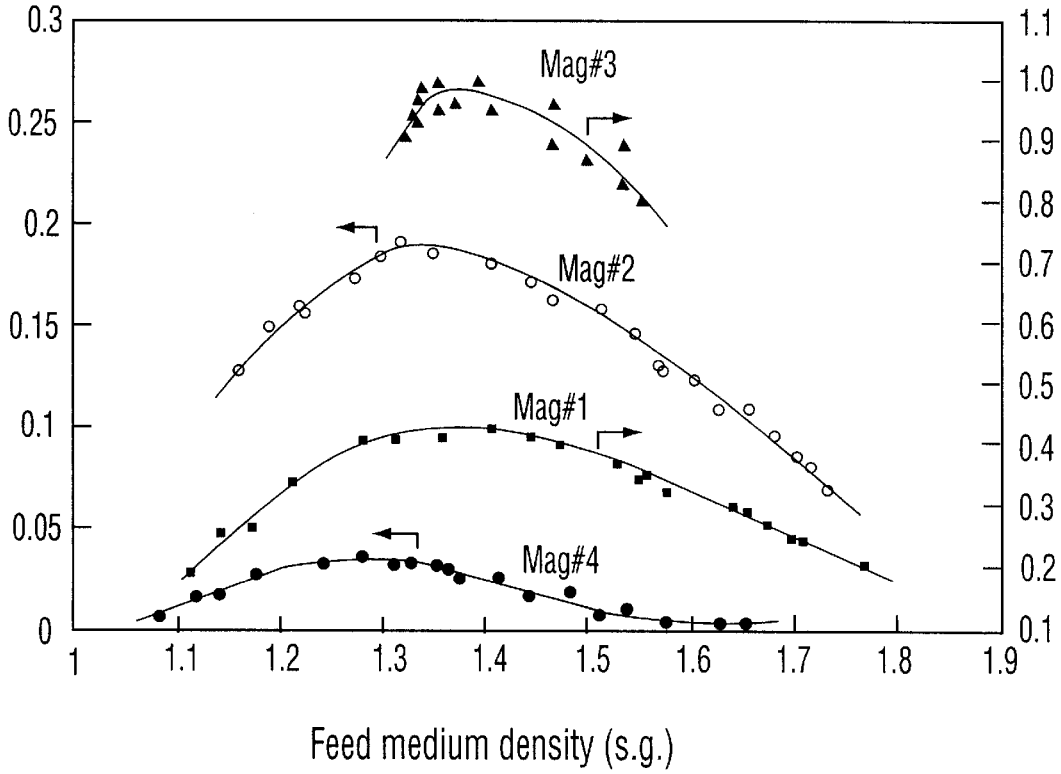
FIG. 3 is a graph which depicts medium stability as a function of magnetite particle size distribution and medium density.

The opposite trends can be attributed to the joint effects of medium stability and rheological properties on the DMC performance. With fine magnetite dense media (Mag#1, Mag#2, and Mag#4), the medium stabilities are high. As shown in FIG. 3, the density differentials can be confined below 0.5 g/cm$^3$ over the entire tested density range. According to Collins et al. (J. S. Afr. IMM, Vol. 12, 103–119 (1974)), the adverse effect of medium instability with such media on separation efficiency is insignificant. A further improvement in medium stability with increasing medium density has a very limited impact on separation efficiency.

The fineness of these magnetite samples, on the other hand, makes the corresponding dense media very viscous. Increasing the medium density can drastically intensify the adverse effect of medium rheology making it the dominant variable in affecting the DMC performance. Thus, increasing the medium density causes the separation efficiency to deteriorate and Ep value to increase.

With the very coarse Mag#3 dense medium, the trend is reversed. In this case, the yield stress and viscosity of the Mag#3 dense medium are extremely low due to its very coarse particle size. In this case, increasing medium density does not notably change the medium rheology, the associated impact of the medium rheology on DMC performance is insignificant. On the other hand, the stability of the Mag#3 dense medium is extremely low. Its density differential ranges from 0.8 to 1.0 g/cm$^3$ (see FIG. 3). The extremely low medium stability exerted a deleterious effect on DMC performance. Increasing the medium density improves medium stability (FIG. 3) and DMC performance (FIG. 2).

The results shown in FIG. 2 indicate that the use of a micronized-magnetite (Mag#4) dense medium hinders DMC separation especially over the high medium density range (>1.5 g/cm$^3$), and that the best DMC performance can be achieved with the coarser Mag#1 (commercial) dense medium. However, these results (FIG. 2) were obtained at low inlet pressure. As shown in FIG. 3, the density differential for the Mag#1 dense medium is close to the upper limit recommended by Collins et al. Any exposure to a higher centrifugal acceleration would cause an excessive medium segregation and affect the separation efficiency. With increasing inlet pressure, as will be discussed later, the DMC performance with the above two magnetite dense media will likely respond in different ways. It may improve with Mag#4 but decrease with Mag#1. In other words, DMC performance is determined not only by the medium properties (or composition), but also by the cyclone operating conditions. An optimum medium composition in one operation can become an inferior one in another when the DMC operating conditions are changed.

It can also be observed from FIG. 2 that the rate with which Ep value increases with medium density is a function of magnetite particle size. The Ep value for finer magnetite media increases very rapidly at higher densities. The most drastic increase in Ep value is observed with the micronized-magnetite (Mag#4) at medium densities above 1.5 g/cm$^3$. As the magnetite particle size increases from Mag#4 to Mag#1, the rate of Ep value variation with medium density decreases. Eventually, it changes its sign to negative with Mag#3 dense medium. The existence of the two opposite trends in FIG. 2 may suggest that there exists a magnetite sample with a particle size distribution somewhere in between Mag#1 and Mag#3, for which the separation efficiency will be independent of medium density over a certain density range.

As shown in FIG. 2, a better separation efficiency over the low medium density range (<1.5 g/cm$^3$) is achieved by using the Mag#1 or Mag#2 dense media. These two were characterized by intermediate particle size distributions and both maintain a higher medium stability without imparting a high yield stress or viscosity to the media. Over the high medium density range (>1.5 g/cm$^3$), medium rheology emerges as a dominant factor in controlling DMC performance. It becomes necessary to use coarse magnetite (Mag#3) to reduce the effect of medium rheology and to achieve a satisfactory separation efficiency.

These results also imply that the magnetite particle distribution is more important than its top particle size in modifying the medium rheology and stability. Although Mag#1 and Mag#3 have the same top particle (Mag#3 was obtained by removing fines from Mag#1), totally different DMC separation results were observed with these two magnetite samples. The most striking dilemma of improving medium properties is that improving medium rheological properties by changing medium composition often results in a deterioration in medium stability, or vice versa. One solution to the problem is the use of bimodal magnetite dense medium. It is known that bimodal suspensions possess very unique rheological properties; a minimum apparent viscosity can be obtained with the bimodal suspensions comprising 25% to 40% fines of the total solid content (C. Parkinson et al., J. Coll. Interf. Sci., Vol. 33, 150–160 (1970); J. S. Chong et al., J. Appl. Polymer Sci., Vol. 15, 2007–2021 (1971); F. Ferrini et al., Proc. 9th Int. Conf. on Hydraulic Transport of Solids in Pipes, Rome, 1984).

For a bimodal suspension to substantially manifest its unique rheological properties, at least a fivefold to sevenfold difference between the sizes of coarse and fine components is required (R. K. McGeary, J. Am. Ceramic Soc., Vol. 44, 513–522 (1961); H. A. Barnes et al., An Introduction to Rheology, Rheology Series 3, Elsevier, N.Y., 1989). In the present tests, Mag#4 and Mag#6 were used as the fine and coarse size fractions, respectively. Their size ratio was about 8:1 (see Table 1). According to the results shown in FIG. 2, the effect of medium rheology on DMC performance becomes significant only at high medium densities. The beneficial effect of using a bimodal dense medium can thus be best demonstrated over the high medium density range. Accordingly, the bimodal medium densities in the present tests were fixed at 1.55 g/cm$^3$.

Figure 4:
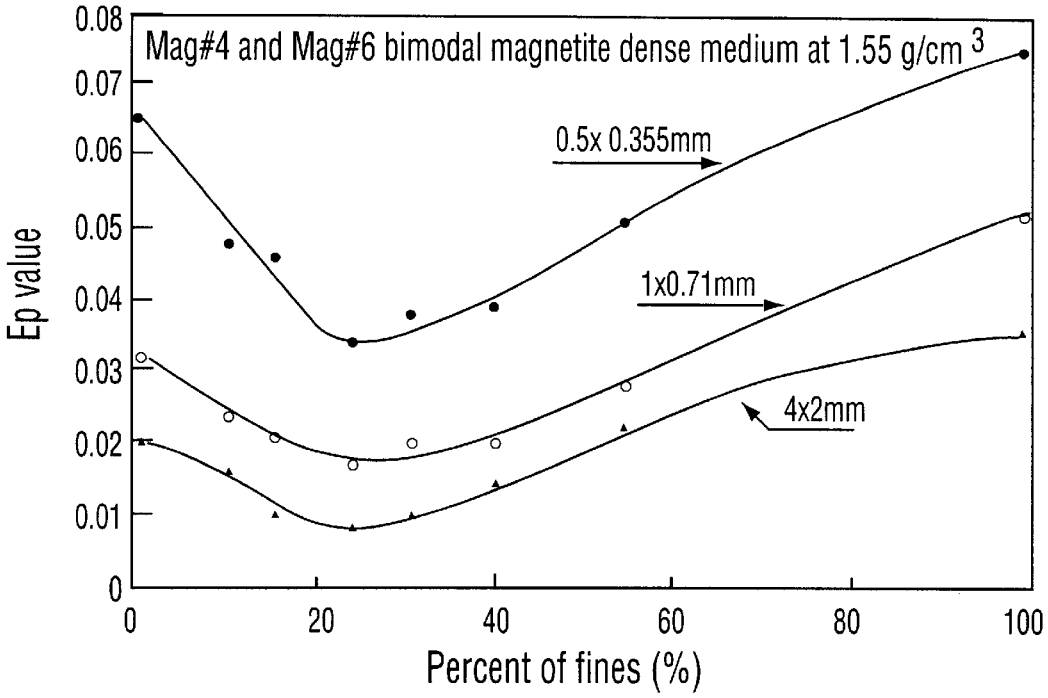
FIG. 4 is a graph which depicts separation efficiency as a function of the proportion of fines in a bimodal dense medium.

At the constant medium density of 1.55 g/cm$^3$, as seen from FIG. 4, the Ep values follow the same trend as the apparent viscosity in response to changes in the percentage of fines in the medium. The separation tests carried out with the use of a 6" dense medium cyclone revealed a significant improvement in separation efficiency when the bimodal dense medium was utilized; this was especially so for the fine feed particles (0.5×0.355 mm).

The minimum Ep value for the 0.5×0.355 mm feed particles with bimodal dense medium was about 0.035, while the Ep values at the same medium density for the Mag#6 and Mag#4 dense media (0% and 100% of fines, respectively) were 0.065 and 0.075, respectively. The optimum separation efficiency was achieved when the bimodal magnetite dense medium contained about 25% of fine magnetite.

Figure 5:
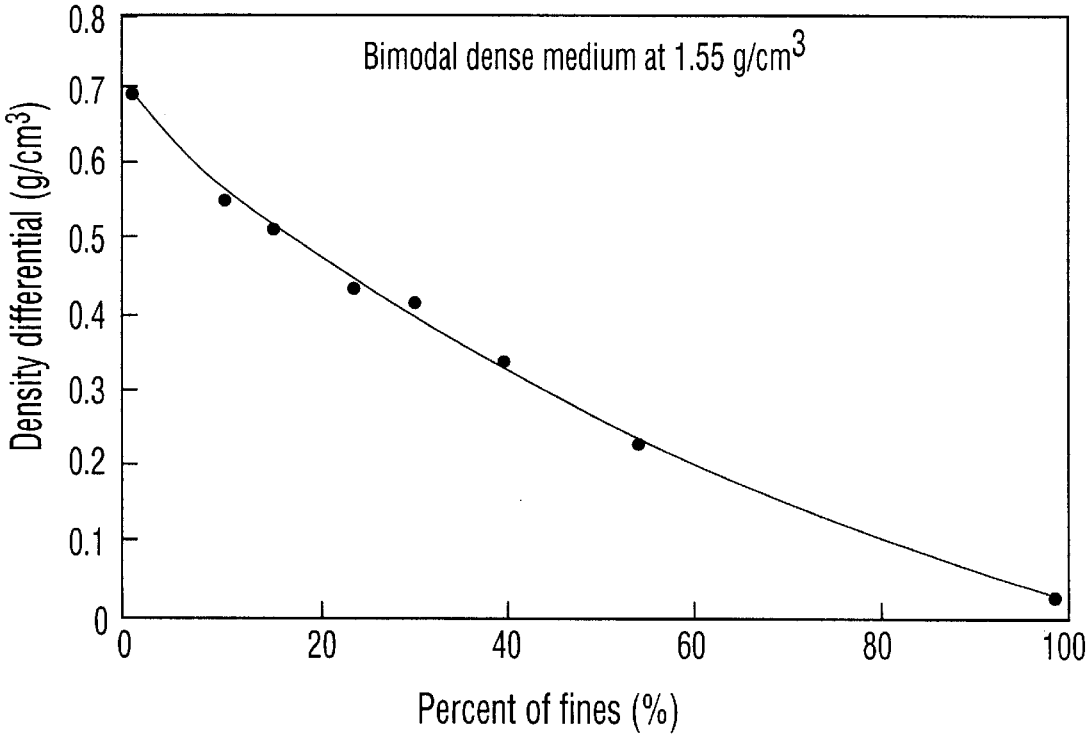
FIG. 5 is a graph which depicts the effect of the bimodal dense medium composition on density differential.

The stability of the bimodal dense medium is not directly related to the medium rheology. FIG. 5 shows that, with increasing percentage of the fines, the density differential decreases continuously and the medium becomes more stable. It is speculated that the density differential is mainly controlled by the classification of the coarse magnetite fraction in the medium, while the fine magnetite suspension serves as the medium for the coarse magnetite fraction. Increasing the percentage of fines in the medium not only inhibits the classification of the coarse particles but also reduces the degree of classification by simultaneously decreasing coarse magnetite content. This is confirmed by the decreasing density of the underflow.

Figure 6:
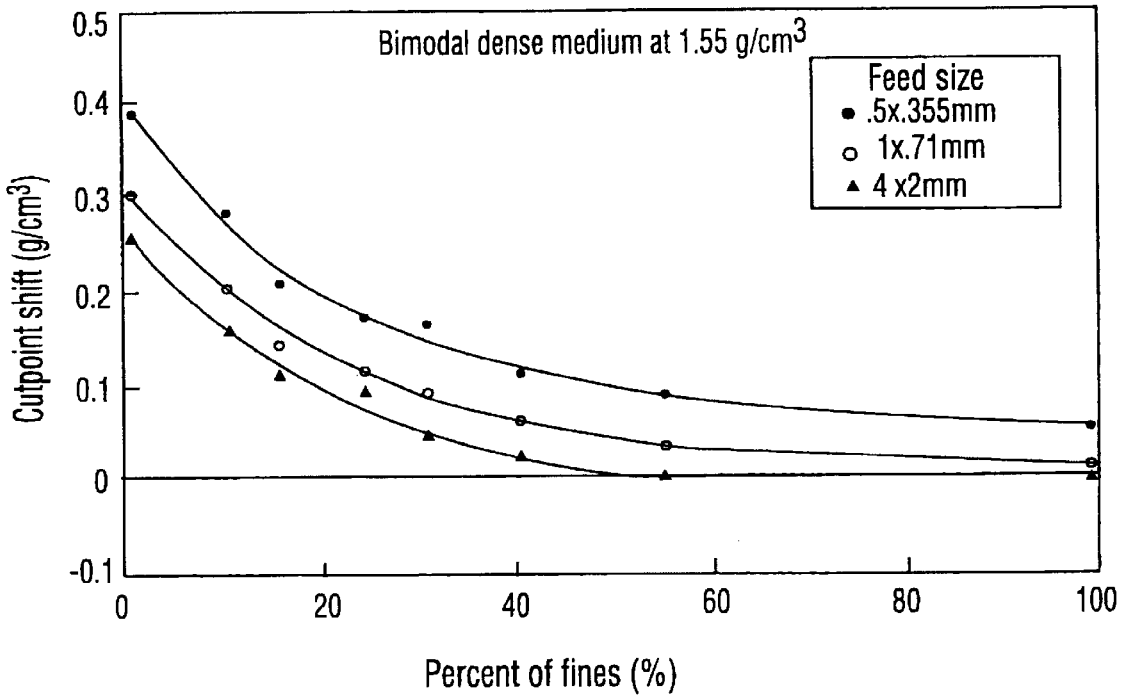
FIG. 6 is a graph which depicts the effect of the bimodal dense medium composition on cutpoint shift.

In contrast to the separation efficiency which is more related to medium rheology, the cutpoint shift, which is defined as the difference between separation cutpoint and medium density, is more closely related to medium stability. As shown in FIGS. 5 and 6, both the cutpoint shift and the density differential follow similar trends in response to the increasing content of fine magnetite.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of separating fine particles differing in density into first and second density fractions which comprises feeding to dense medium separator mixed first and second density fractions containing fine particles and a dense medium that includes water and ferromagnetic particles having a relative density range from about 4.0 to 7.0, a bimodal size distribution characterized by about 20–40% wt. fine and 60–80% wt. coarse fractions, with coarse-to-fine particle size ratio in the range from about 5 to about 10, and retrieving the separated first and second density fractions.

2. A method as claimed in claim 1 wherein the separator is a cyclonic separator.

3. A method as claimed in claim 2 wherein the separator is a dense medium cyclone and dense medium feed to the dense medium cyclone includes fine coal particles of less than 600 microns size, and the bimodal dense medium has a medium relative density from about 1.2 to about 1.9.

4. The method of claim 3 wherein the ferromagnetic particles in the dense medium are $Fe_3O_4$.

5. The method of claim 3 wherein the ferromagnetic particles in the dense medium are FeSi.

6. The method of claim 2 wherein the ferromagnetic particles in the dense medium are $Fe_3O_4$.

7. The method of claim 2 wherein the ferromagnetic particles in the dense medium are FeSi.

8. A method of cleaning coal which comprises feeding to a dense medium cyclone a mixture of:

(a) fine coal particles;

(b) water; and (c) ferromagnetic particles having a relative density range from about 4.0 to about 7.0, a bimodal size distribution characterized by about 20–40% wt. fine fractions and about 60–80% wt. coarse fractions, with a coarse-to-fine particle size ratio in the range of about 5 to 10, and retrieving the separated claimed fine coal and the water and ferromagnetic particles.

9. A method as claimed in claim 8 wherein the mixture is fed to the dense medium cyclone at an inlet pressure from about 40 kPa to about 400 kPa.

10. A method as claimed in claim 8 wherein the fine coal particles are less than 600 microns in size.

11. A method as claimed in claim 10 wherein the bimodal magnetite dense medium has a medium relative density from about 1.2 to about 1.9.

12. A method as claimed in claim 11 wherein the ferromagnetic particles are selected from the group consisting of $Fe_3O_4$ and FeSi.

13. A method as claimed in claim 8 wherein the ferromagnetic particles have a particle size of less than about 15 microns.

14. A method as claimed in claim 8 wherein fine ferromagnetic particles have a size in the range of about 1 to about 10 microns and coarse ferromagnetic particles have a size in the range of about 10 to about 45 microns.

15. A method of cleaning coal which comprises feeding to a dense medium dynamic separator a mixture of:

(a) fine coal particles;

(b) water; and (c) ferromagnetic particles having a relative density range from about 4.0 to about 7.0, a bimodal size distribution characterized by about 20–40% wt. fine fractions and about 60–80% wt. coarse fractions, with a coarse-to-fine particle size ratio in the range of about 5 to 10, and retrieving the separated claimed fine coal and the water and ferromagnetic particles.

* * * * *